United States Patent [19]

Callison

[11] 4,425,901

[45] Jan. 17, 1984

[54] HEAT EXCHANGE DEVICE

[76] Inventor: Gordon Callison, Box 638, R.D. #2, Waverly, N.Y. 14892

[21] Appl. No.: 273,678

[22] Filed: Jun. 15, 1981

[51] Int. Cl.[3] ..... F24C 1/14; F24C 15/10

[52] U.S. Cl. ..... 126/6; 126/4; 126/72; 126/220; 165/DIG. 2

[58] Field of Search ..... 165/47, DIG. 2, DIG. 12; 122/22 B; 126/364, 72; 237/55

[56] References Cited

U.S. PATENT DOCUMENTS

| | | | |
|---|---|---|---|
| 20,733 | 6/1858 | Savage | 126/6 |
| 2,244,831 | 6/1941 | Drichta et al. | 237/16 |
| 2,553,278 | 5/1951 | Rogant | 126/6 |
| 3,280,813 | 10/1966 | Schaensjer | 126/4 |
| 4,206,742 | 6/1980 | Johnson | 237/55 |

FOREIGN PATENT DOCUMENTS

| | | | |
|---|---|---|---|
| 154034 | 4/1956 | Sweden | 126/20 |

*Primary Examiner*—Albert W. Davis, Jr.
*Assistant Examiner*—S. G. Dotson
*Attorney, Agent, or Firm*—Charles S. McGuire

[57] ABSTRACT

A heat exchange device is adapted to recover heat from the fire box of a wood burning stove or the like for heating ambient air in a room or other enclosed space. The heat exchange device is adapted to mount in a recess in a stove top in place of a lid which is normally supplied with the stove. The device according to the invention includes heat exchange means which extend into the fire box of the stove below the top surface thereof. The heat from the heat exchange device is transmitted into a main cavity of the device where the heat is transferred to air forced through the main cavity by a blower mounted to an outside surface of the device. Air exit means are provided on a surface opposite to the surface on which the blower is mounted to provide a passage for heated air into the room or other enclosed space to be heated. The device may also include a top mounted isolated handle for ease in handling the device such as for moving from one area to another. In a second embodiment of the device, a high temperature heat exchange glass plate is mounted on the surface of the device which is in contact with the fire box. Heat is transmitted by heat exchange plate to the main cavity of the device where the air is heated and blown into the room as above.

4 Claims, 8 Drawing Figures

HEAT EXCHANGE DEVICE

BACKGROUND OF THE INVENTION

The present invention relates to heat exchange devices and more particularly to heat exchange devices for recapturing heat normally lost from a wood burning stove or the like for use in heating ambient air of an enclosed space.

In the prior art there are a number of devices shown for recovering heat from a surface of a wood stove or similar heat source. However, each of the prior art devices of which the inventor is aware have one or more disadvantages which are not present with the instant invention.

U.S. Pat. No. 97,678 shows a heater attachment for stoves or ranges adapted to receiving the heat from the top of the stove to heat other rooms in a building.

The attachment shown in the patent does not provide a heat exchange device which extends into the fire box of the stove nor does the patented device include a blower for moving the heated air nor handle for ease of handling the heat exchange device.

U.S. Pat. No. 472,755 shows a heat exchange device constructed of cast iron with an air tight bottom portion which fits into a recess of a stove. Heat is transmitted either through a hot air pipe to another floor of a building or through one or more valves into the room in which the stove is located.

The device according to the patent does not provide any means for moving a large quantity of ambient air through a heat exchange device nor does the patented device include any baffle or heat exchange tube for increasing the area within the heat exchanger for enhancing the efficiency of heating ambient air as it passes through the device.

U.S. Pat. No. 2,553,278 shows a hood device which is mounted over a number of gas burners on a stove including a blower and a number of exit ports for transmitting heat captured under the hood device to the ambient air surrounding the stove.

The apparatus according to the patent does not include means for exchanging heat which means extend into the fire box nor does the hood arrangement of the patent show any heat exchange tubes or baffles for increasing the efficiency of the heat exchange within the system.

U.S. Pat. No. 3,533,466 shows a tubular heat exchanger for use in cooling combustion gases of a refuse incinerator by means of cold air. A number of vertical steel tubes are provided for the upward passage of the combustion gases which are mounted within a casing. Cooling air is supplied in two streams flowing crosswise with respect to the verticle tubes. The volume of one of the air streams is controlled in dependence upon the outlet temperature of the cooled combustion gases.

The patented heat exchanger is fundamentally an in line device in which exhaust gases from the heat source pass through the steel tubes. This system is distinct from a system in which a heat exchanger extends into the fire box and collects heated air within a main cavity of a heat exchange device but wherein the exhaust gases from the heat source do not pass through the heat exchange device as is shown by the patent.

U.S. Pat. No. 4,050,628 also shows an apparatus for reclaiming heat and for controlling the flow of combustion gases passing through a flue from a heater to an exhaust stack. As with the patent identified immediately above, the heat reclaimer according to the identified patent employs exhaust gases passing through the heat exchange device to provide the heat for heating ambient air. This patent does not show a heat exchange device extending into the fire box of the heat source. Also, the device according to the patent does not show means for moving a large volume of air through the heat exchanger to provide adequate heat to heat a room or other enclosed space.

U.S. Pat. No. 4,206,742 shows apparatus for extracting heat from exhaust gases of a stove to heat the air in a room. A heat exchange chamber includes an inner core having a number of passageways through which waste gases pass. The air surrounding the inner core is heated by the passage of the exhaust gases which then exit into the flue.

As with other patented devices which are mounted in line with the exhaust gases from the heat source, heat is recovered from exhaust gases which pass through the heat extractor.

U.S. Pat. No. 4,213,443 shows a rectangular stove structure having a step top with a sloped intermediate top portion having heated air outlets. Room air is passed through U-shaped ducts arranged along the inside surface of the side walls of the stove and fire brick is provided on the floor of the stove structure between the ducts. Air is drawn into the ducts through a side opening having a blower associated therewith.

The patent relates to a stove structure including means within the fire box for heating ambient air. The patent does not show a device for mounting on a top surface of a stove structure with heat exchange means extending into the fire box, a blower for moving heated ambient air through the heat exchanger and a number of sealed heat exchange tubes for transmitting heat to ambient air in an efficient manner.

U.S. Pat. No. 4,219,073 shows a heat exchanger which is adapted to be mounted in an exhaust stack of an oil or natural gas furnace including a heat exchange chamber with a plurality of separate closely packed tubular conduits arranged to transport hot exhaust gases there through, a fan assembly attached to a side wall to force ambient air around the plurality of tubular contuits to heat the ambient air and a thermostat extending into the ambient air passageway for monitoring the ambient air temperature and selectively actuating the fan assembly at pre-set temperatures.

As with the patents identified above, the patented structure is designed to be mounted in an exhaust stack and have exhaust gases pass through the tubular conduits. The patented device is not adapted to be mounted on a top surface of a stove with a heat exchanger which extends into the fire box nor does it have tubular heat exchange members which are sealed at one end thereof for providing efficient transfer of heat energy to ambient air which is forced through the heat exchanger by a blower.

Each of the prior art devices discussed has one or more disadvantages which compared to the instant invention as will be seen from the following summary of the invention.

SUMMARY OF THE INVENTION

Therefore, it is an object of the present invention to transfer heat from a fire box of a stove similar heat source to ambient air by a heat exchange device having one or more heat exchange members which extend into the fire box of the heat source and which transmit heat to a chamber through which ambient air is passed to collect heat for heating a room or other enclosed space.

It is another object of the present invention to transfer heat from a heat source to ambient air by a heat exchange device as above having one or more heat exchange members for transmitting heat to a chamber, said chamber having one or more baffles therein through which ambient air is passed to collect heat for heating an enclosed space.

It is a further object of the present invention to transfer heat from a heat source to ambient air by a heat exchange device as above which further includes a blower for forcing ambient air through the chamber and for moving the heated ambient air out of said chamber to the enclosed space to be heated.

It is yet another object of the present invention to transfer heat from a heat source to ambient air by a heat exchange device as above which further includes a thermostat control connected to said blower to apply energy to said blower when the internal temperature of said chamber exceeds a predetermined temperature and to remove energy from said blower when the internal temperature of said chamber drops below a second pre-set temperature.

Accordingly, a heat exchange device according to the present invention includes an container forming an air tight chamber, a number of heat exchange tubes closed at the top end thereof and with the open bottom end extending into the fire box of the heat source below a base plate of the heat exchange device, a blower mounted on one side wall of the container for forcing ambient air through the heat chamber, a number of air outlets on a wall of the container opposite the blower for allowing heated air to escape from the chamber, a thermostatic control for controlling the operation of the blower in accordance with the internal temperature of the heat chamber and a heat isolated handle for moving the heat exchange device from place to place.

In a second embodiment of the present invention, heat exchange is accomplished by a high temperature glass plate mounted in the base plate of the heat exchange device in place of the heat exchange tubes and a number of baffles are mounted within the chamber to increase efficiency of heat transfer to the ambient air forced through the chamber by the blower.

It is a feature of the present invention that a heat exchange device may be mounted in an opening in a stove top of a wood burning stove or similar heat source to extract maximum heat from the heat source to heat the ambient air.

It is another feature of the present invention that the heat exchange device may be readily carried from place to place through the use of a heat isolated handle mounted to the top of the heat exchange device.

These and other objects of the present invention will become immediately apparent from the following detailed description in conjunction with the accompanying drawing.

DETAILED DESCRIPTION OF PREFERRED EMBODIMENTS OF THE INVENTION

In the prior art, there are many stoves which have openings in a top surface thereof generally covered by removable plates. An example of such stove is that shown in U.S. Pat. No. 97,678 described above.

The present invention employs a novel heat exchange means which is mounted on a top surface of such a stove having an opening therein to heat ambient air in an efficient manner.

Figure 1:
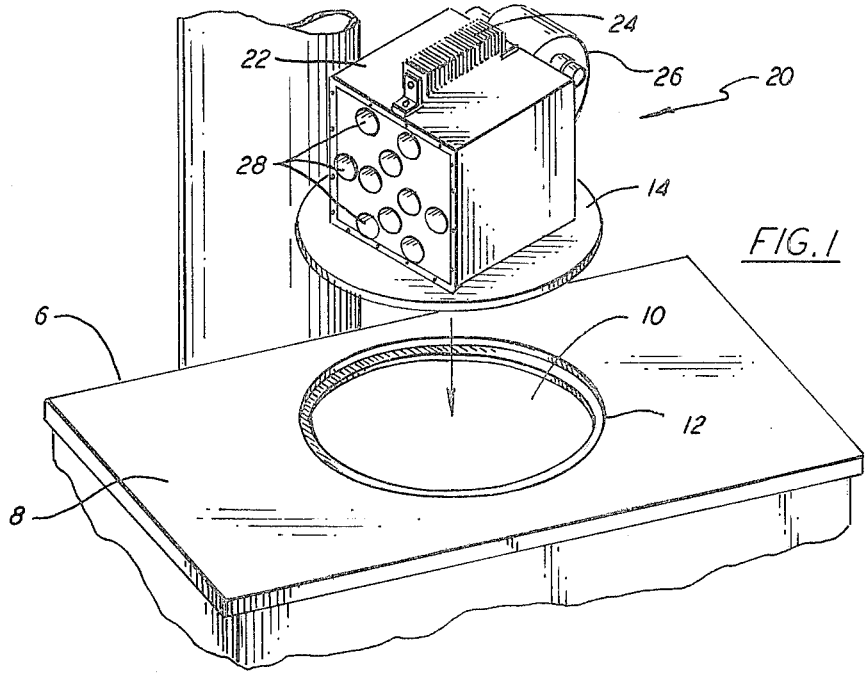
FIG. 1 is an isometric drawing of a heat exchange device according to the present invention showing the installation of the device in a heat source such as a wood burning stove.

Referring now to FIG. 1, stove 6 has a top surface 8 having opening 10 therein. Opening 10 has a peripheral lip 12 which mates with cover plate 14 and provides a substantially air tight seal. Heat exchange device 20 is mounted on cover plate 14. Heat exchange device 20 includes a metal container 22, an isolated handle assembly 24, blower assembly 26 and a plurality of hot air outlets 28.

Figure 2A:
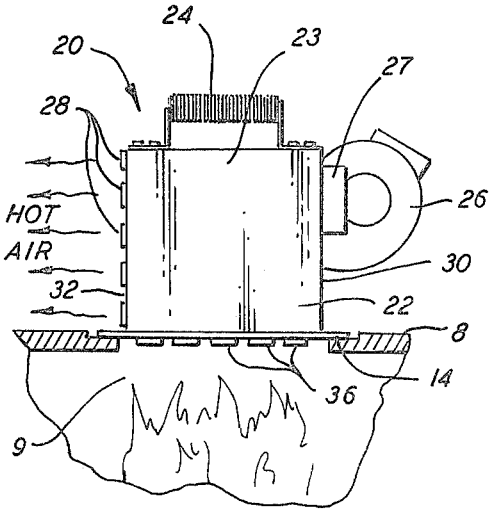
FIG. 2A is a side view of the heat exchange device according to a first embodiment of the present invention.
Figure 2B:
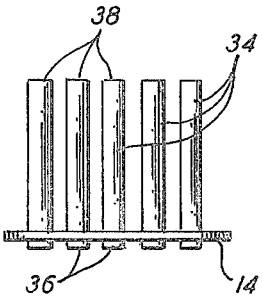
FIG. 2B is a side view of the internal structure of the heat exchange device of FIG. 2A.
Figure 2C:
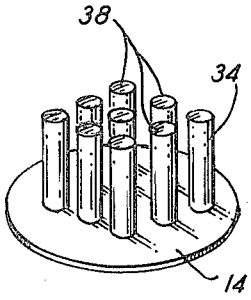
FIG. 2C is an isometric view of the internal structure shown in FIG. 2B.

Referring now to FIGS. 2A, 2B and 2C, a first embodiment of the present invention will be described in greater detail. Blower assembly 26 is mounted on a first side surface 30 of container 22. Hot air outlets 28 are provided as holes large enough for the passage of heated air on a side 32 opposite side surface 30 on which blower 26 is mounted. A number of heat exchange tubes 34 are mounted on cover plate 14 such that the open ended portion 36 of tubes 34 extend a small distance below the bottom of plate 14 and into fire box 9 of stove 6. Heat exchange tubes 34 are open at the bottom end 36 thereof and are sealed at top ends 38 so that heat from fire box 9 will flow into heat exchange tubes 34 and be captured therein with no transmittal of exhaust products to the ambient air. Blower assembly 26 forces ambient air through container 22 through and around heat exchange tubes 34 where the ambient air is heated and discharged at outlets 28 at a higher temperature than the input temperature.

Electrical power applied to blower assembly 26 is controlled by thermostatic control 27 which is adjusted to connect power to the blower assembly 26 when the internal temperature of chamber 23 exceeds a first predetermined value and disconnect power from blower 26 when the internal temperature of chamber 23 drops below a second pre-set temperature. As an example, the blower turn on temperature may be set to 130 degrees Fahrenheit while the blower turn off temperature might be set to 110 degrees Fahrenheit. Thus as the air in chamber 23 of heat exchange device 20 is heated, when the internal temperature achieves 130 degrees Fahrenheit, thermostatic control 27 applies power to blower assembly 26 which causes ambient air to be forced through chamber 23. As the temperature of the heat source such as stove 6 reduces, when a second pre-set temperature such as 110 degrees Fahrenheit is reached, power is disconnected from blower assembly 26 thru shutting down the heat exchange blower until the temperature again rises above the first pre-set value.

Referring now to FIGS. 3, 4, 5 and 6, a second embodiment of the present invention will be described.

Figure 3:
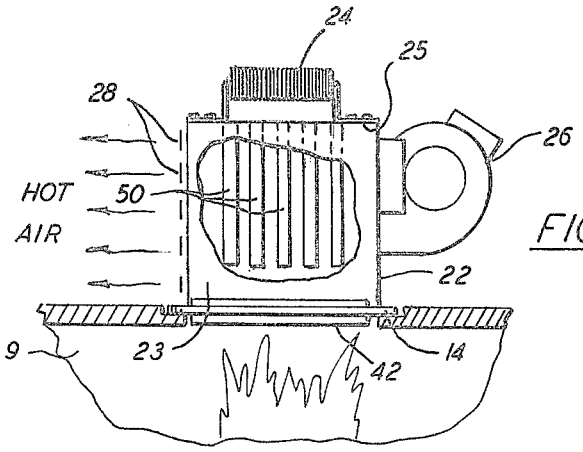
FIG. 3 is a side partial section view of a second embodiment of a heat exchange device according to the present invention.
Figure 6:
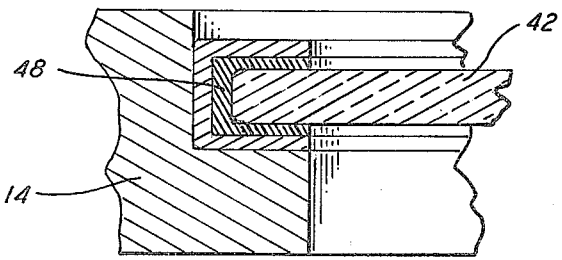
FIG. 6 is a section view of a portion of the base plate shown in FIGS. 4 and 5 detailing the mounting of a heat exchange plate.
Figure 4:
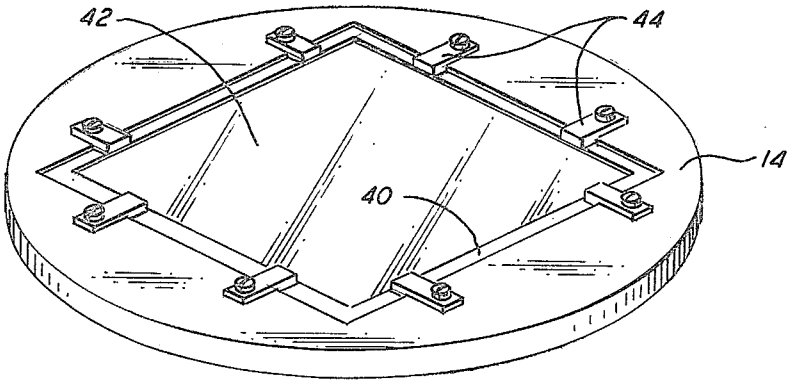
FIG. 4 is an isometric view of a base plate of the device according to a second embodiment of the present invention.
Figure 5:
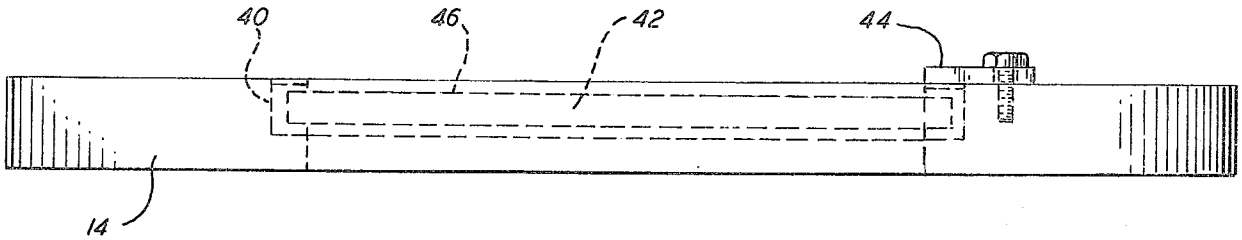
FIG. 5 is a side section view of the base plate shown in FIG. 4.

Referring to FIG. 3, it can be seen that container 22, handle assembly 24, blower assembly 26 and heated air outlets 28 are identical with the first embodiment of the present invention as described above. The difference between the first embodiment as described above and the second embodiment described herein is in the structure of the heat exchanger. In the second embodiment, cover plate 14 has mounted in a centrally located opening 40 a heat exchange plate 42 of high temperature glass or other similar material. Heat exchange plate 42 is held in position by a number of hold down devices 44 mounted around opening 40 in cover plate 14 and bearing on a top surface 46 of heat exchange plate 42.

A heat resistant expansion joint gasket 48 surrounds the perimeter of heat exchange plate 42 to avoid damage to plate 42 due to expansion or contraction of plate 14 with changes in temperature.

In the second embodiment of the invention as described herein, heat from fire box 9 is transmitted by heat exchange plate 42 to inner chamber 23 of heat exchange device 20. A number of baffles plates 50 (see FIG. 3) are mounted to the top surface 25 of container 22. Baffles 50 enhance heat exchange between the heat given off by heat exchange plate 42 and ambient air forced through chamber 23 by blower assembly 26.

Although a preferred embodiment of the invention has been described, it will be apparent to those skilled in the art that there are many variations and modifications which may be made without departing from the spirit or scope of the invention. Therefore, the invention is not to be limited by the specific disclosure of a preferred embodiment herein, but only by the appended claims.

What is claimed is:

1. In combination with a wood burning type stove a heat exchange device for transferring heat from said wood burning stove having a circular opening of first predetermined diameter surrounded by a peripheral lip of second predetermined diameter in a top wall thereof, said opening directly overlying the fire box of the stove, said device comprising:

(a) an essentially flat, circular plate having a diameter between said first and second diameters and thus adapted to lie in covering relation to said opening, surrounded by said lip;

(b) a plurality of elongated, hollow tubular members of substantially equal length extending through said plate and having lower open ends and upper closed ends, whereby when said plate is in covering relation to said opening said lower ends extend into the stove fire box;

(c) housing means affixed to the upper surface of said plate and enclosing all of the portions of said tubes on the upper side of said plate which portions extend substantially to the top of said housing;

(d) said housing having first and second vertical walls on opposite sides thereof, said first wall having a first opening therethrough and said second wall having a plurality of second openings therethrough; and (e) blower means affixed to said housing in surrounding relation to said first opening to direct air from outside to inside said housing, whereby air passes through said first opening, through said housing in contact with the portions of said tubes on the upper side of said plate to receive heat therefrom and out of said housing through said second plurality of openings to heat the ambient air.

2. A heat exchange device according to claim 1 wherein the majority of the length of said tubes is on the upper side of said plate.

3. A heat exchange device according to claim 2 further comprising a thermostatic control device for controlling the operation of said blower.

4. A heat exchange device according to claim 2 further comprising a heat isolated handle mounted on a top surface of said heat exchange device so that said heat exchange device may be readily transported.

* * * * *